US005368255A

United States Patent [19]

August

[11] Patent Number: 5,368,255

[45] Date of Patent: Nov. 29, 1994

[54] AEROTUMBLING MISSILE

[75] Inventor: Henry August, Chatsworth, Calif.

[73] Assignee: Hughes Aircraft Company, Los Angeles, Calif.

[21] Appl. No.: 894,146

[22] Filed: Jun. 4, 1992

[51] Int. Cl.[5] ..... F42B 10/00; F42B 15/00

[52] U.S. Cl. ..... 244/3.28; 102/400; 244/3.1; 244/3.21

[58] Field of Search ..... 244/3.1, 3.21, 3.24, 244/3.25, 3.27, 3.28, 3.29, 3.22; 102/386, 388, 399, 400, 529, 384; 114/20.1

[56] References Cited

U.S. PATENT DOCUMENTS

| | | | |
|---|---|---|---|
| 1,166,879 | 1/1916 | Alard | 244/3.29 |
| 1,201,763 | 10/1916 | Rimailho | 244/3.27 |
| 3,093,346 | 6/1963 | Faget et al. | 244/3.22 |
| 3,098,445 | 7/1963 | Jackson | 244/3.29 |
| 3,141,297 | 7/1964 | Shields | 102/378 |
| 3,141,409 | 7/1964 | Travis et al. | 244/3.25 |
| 3,415,467 | 12/1968 | Barringer | 244/3.29 |
| 4,013,009 | 3/1977 | Claude et al. | 244/3.27 |
| 4,175,491 | 11/1979 | Thomanek | 244/3.27 |
| 4,607,810 | 8/1986 | Frazer | 244/3.29 |
| 4,996,924 | 3/1991 | McClain | 102/501 |

FOREIGN PATENT DOCUMENTS

| | | | |
|---|---|---|---|
| 333681 | 9/1989 | European Pat. Off. | 244/3.29 |
| 2264337 | 7/1974 | Germany | 244/3.28 |
| 2429912 | 1/1975 | Germany | 102/340 |
| 3222378 | 12/1983 | Germany | 244/3.1 |
| 8500702 | 10/1986 | Netherlands | 102/388 |
| 2077399 | 12/1981 | United Kingdom | 244/3.28 |

*Primary Examiner*—Harold J. Tudor

*Attorney, Agent, or Firm*—Randall M. Heald; Charles D. Brown; Wanda K. Denson-Low

[57] ABSTRACT

A missile includes a missile body having a nose, a tail, and a center of gravity therebetween. A plurality of blades are arranged symmetrically around the missile body at a location between the nose and the center of gravity. The blades are deployable from a stowed position folded flat against the body of the missile to a deployed position extending outwardly from the body of the missile, and are mounted so as to be biased toward the deployed position. A retaining wire extends circumferentially around the body of the missile and captures the blades thereunder. The retaining wire may be controllably severed by a pyrotechnic device to release the blades to extend to the deployed position. The extended blades cause the missile to tumble from a first stable orientation to a second stable orientation, permitting it to be quickly pointed in the opposite direction without expenditure of fuel.

15 Claims, 2 Drawing Sheets

AEROTUMBLING MISSILE

BACKGROUND OF THE INVENTION

This invention relates to the control of missiles in flight, and, more particularly, to a device that quickly reverses the direction of flight of a missile without expenditure of propellant.

Air-to-air missiles are a primary weapon system for many military fighter and bomber aircraft. On fighter aircraft the missiles may play offensive or defensive roles, and on bomber aircraft usually play a defensive role. The missiles are often carried on external pylon supports so that they may be launched quickly, but sometimes are carried internally.

The missiles are normally carried in a forward-facing orientation. That is, the missile is aerodynamically shaped to move through the air with low drag. The missile is mounted on the aircraft so that the aerodynamic shape faces forwardly. With the missile facing forwardly, its addition to the drag of the aircraft prior to launch is smaller than if the missile were carried facing rearwardly. Moreover, when the missile is launched its forward-facing orientation aids in assuring a stable launch from the aircraft. If the missile were carried facing rearwardly, upon launch it might veer out of control and actually strike the launching aircraft before the missile engine is fired and the missile guidance system becomes operable.

Attacks on a defended aircraft by an opposing aircraft often occur with the opposing aircraft behind the defended aircraft. The defended aircraft can use its air-to-air missiles to defend itself, if the missiles can be brought to bear on the opposing aircraft. For a forwardly facing and launched missile, the missile must fly in a curved arc through 180 degrees to bear on the opposing aircraft. The turn requires both expenditure of fuel and time. In many situations it is not possible to bring the forwardly launched missile to bear on the opposing aircraft in time to be effective.

On the other hand, the missile may be carried in a rearwardly facing orientation, but, as noted, the aerodynamics of the carrying aircraft will be degraded prior to launch, and it may be very difficult to launch a missile in a stable manner. Moreover, fighter aircraft may carry only 2 or 4 air-to-air missiles. If one or more of these missiles is mounted in a rearwardly facing, defensive position, it essentially becomes unavailable for use in the aircraft's primary role of attacking (rather than defending against) opposing aircraft.

Various types of rearward defense of aircraft have been used. In the past, rearwardly facing guns have been employed, but such guns are not practical for fighter aircraft or for most high-speed bomber aircraft. Various masking devices can also be used, but are not effective for active defense against close-in attacks.

Thus, there is a need for an improved approach to defending against attacks by opposing aircraft from behind a defended aircraft using its air-to-air missiles, without reducing the effectiveness of the defended aircraft. The present invention fulfills this need, and further provides related advantages.

SUMMARY OF THE INVENTION

The present invention provides a modification to the structure of a conventional air-to-air missile that makes it effective for either attack against aircraft in front of the carrying aircraft (launch vehicle) or defense against attack by aircraft behind the carrying aircraft. The missile of the invention is carried in a forwardly facing orientation, so that its presence does not degrade performance of the carrying aircraft. It is launched in the forwardly facing orientation, so that a stable launch from the carrying aircraft can be achieved in the conventional manner. After launch, the missile can be converted from forward-facing attack to rearward-facing defense quickly and without the expenditure of fuel.

In accordance with the invention, a missile comprises a missile body having a nose, a tail, and a center of gravity therebetween, the missile body having a first stable orientation with the nose pointed into a flowing fluid stream. The missile includes a controllable means operable in a flowing fluid stream for forcing the missile to tumble from the first stable orientation to a second stable orientation with the tail facing toward the flowing stream, and means for operating the means for forcing.

The missile is carried on a launching vehicle with the missile in the first stable orientation and the means for forcing inoperable. After launch with the missile in the first stable orientation, the means for forcing is operated to tumble the missile to a second stable orientation, which faces rearwardly. The missile's engine, if any, is thereafter fired to drive the missile in the direction opposite to the direction of movement of the launch vehicle. The missile can be a missile that flies through the air and is launched from an aircraft, or a torpedo that is propelled through the water and is launched from a ship.

In one embodiment the controllable means for forcing the missile to tumble from the first stable orientation to the second stable orientation is a set of lifting surfaces that are extendable into the fluid stream. These lifting surfaces, preferably in the form of a plurality of blades disposed around the circumference of the missile at a location between the nose and the center of gravity of the missile, are initially not deployed into the fluid stream prior to launch when the missile is carried on the launch vehicle. The lifting surfaces are not deployed initially both because they would tend to cause the missile to apply tumbling forces before and during missile launch, and because they increase the effective diameter of the missile. Prior to deployment, the lifting surfaces can be wrapped circumferentially around the missile body, or folded flat back against the missile body.

After the missile is launched and drops free of the launch vehicle, the means for forcing the missile to tumble is deployed if the missile is to be directed to the rear (or not deployed if the missile is to be fired forwardly). In a preferred embodiment, the lifting surfaces are biased toward the deployed position but held in the folded position by a release mechanism. One form of release mechanism is a wire that extends circumferentially around the missile and engages the lifting surfaces in the folded position to maintain them in the folded position. When the lifting surfaces are to be deployed to cause the missile to tumble to the rearwardly facing orientation, the wire is parted by a pyrotechnic charge or other device that causes the wire to separate, permitting the lifting surfaces to spring outwardly under the biasing force to the deployed position. The deployed lifting surfaces cause the missile to tumble to the second stable orientation facing rearwardly. The missile is thereby reoriented from a forwardly facing, primary offensive orientation, to a rearwardly facing, primary defensive orientation, very quickly after launch and without any expenditure of fuel. A mechanism to release the blades to fall away from the missile after operation of the deployable aerotumbling device can also be provided.

Thus, in accordance with the invention, a missile comprises a missile body having a nose, a tail, and a center of gravity therebetween, and a first stable orientation with the nose pointed into a flowing fluid stream. A deployable means is operable in a flowing fluid stream for destabilizing the missile so that it is no longer stable with the nose pointed into the flowing fluid stream. There is also means for controllably deploying the deployable means.

The missile of the invention provides an important advance in the art of missile systems, and, particularly, to the art of missiles that may be used both offensively and defensively. Other features and advantages of the invention will be apparent from the following more detailed description of the invention, taken in conjunction with the accompanying drawings, which illustrate, by way of example, the principles of the invention.

DETAILED DESCRIPTION OF THE INVENTION

Figure 1:
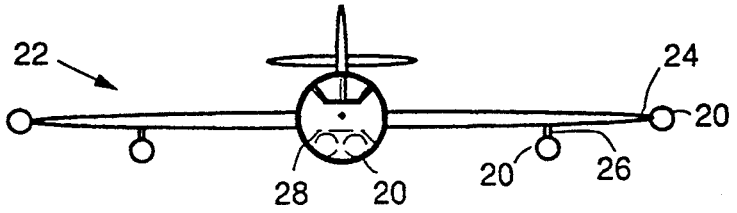
FIG. 1 is a front elevational view of an aircraft carrying several missiles.

In the preferred embodiment, the approach of the invention is used in conjunction with an air-to-air missile 20, that is initially carried upon an aircraft 22 as shown in FIG. 1. The missile 20 may be mounted externally at a wingtip 24 of the aircraft 22, externally on a pylon 26 extending downwardly from a wing (as shown) or from the fuselage of the aircraft, or internally in a weapons bay 28 (shown in phantom lines). The term "forwardly facing orientation" means that, if the engine of the missile were fired immediately after launch, the missile would fly in the same direction as the aircraft 22 is moving. An existing mechanism is used to release the missile 20 from the aircraft 22 upon command of the aircraft crew 22.

Figure 2:
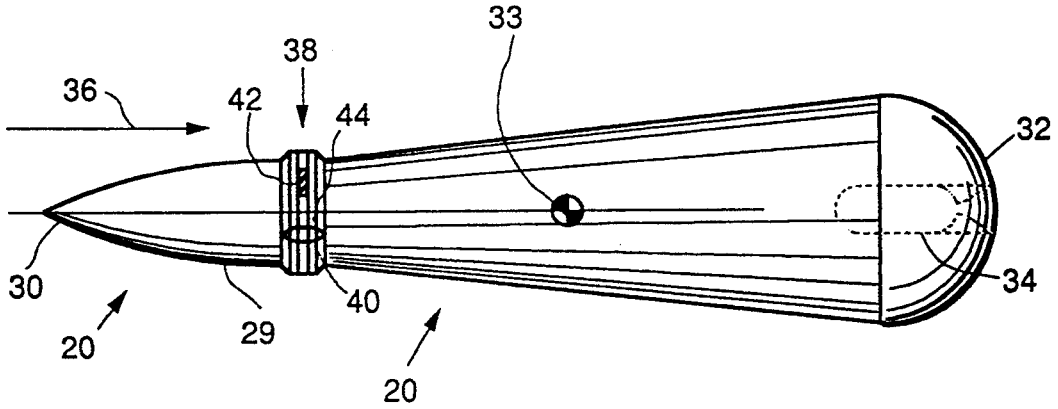
FIG. 2 is a side elevational view of a missile having a circumferentially folded aerotumbling device prior to deployment.

FIG. 2 illustrates one embodiment of the missile 20 in greater detail. The missile has a body 29, a nose 30, a tail 32, and a center of gravity 33 between the nose 30 and the tail 32. The missile also may (and usually does) have a propulsion engine 34 (shown in phantom lines) mounted internally with its exhaust directed rearwardly from the tail 32. In the particular type of missile 20 illustrated in FIG. 2, the missile has an elongated teardrop shape, without control surfaces. However, the missile may have control surfaces. If the missile has control surfaces, these surfaces may be moved to control the flight direction after launch. If the missile does not have control surfaces, small rocket thrusters are usually provided to control the direction of flight. The basic aerodynamic design of the depicted missile, with a pointed nose 30 and a larger diameter tail 32 provides a first stable orientation with the nose 30 pointed into a flowing fluid stream, whose direction is indicated by an arrow 36.

Figure 3:
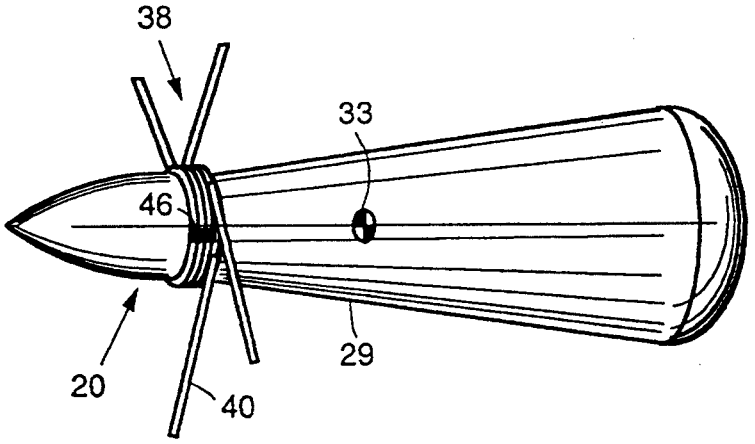
FIG. 3 is a perspective view of the missile of FIG. 2, with the aerotumbling device deployed.
Figures 4, 4A, 4B, 4C, 4D, 4E, 4F, 5, 6:
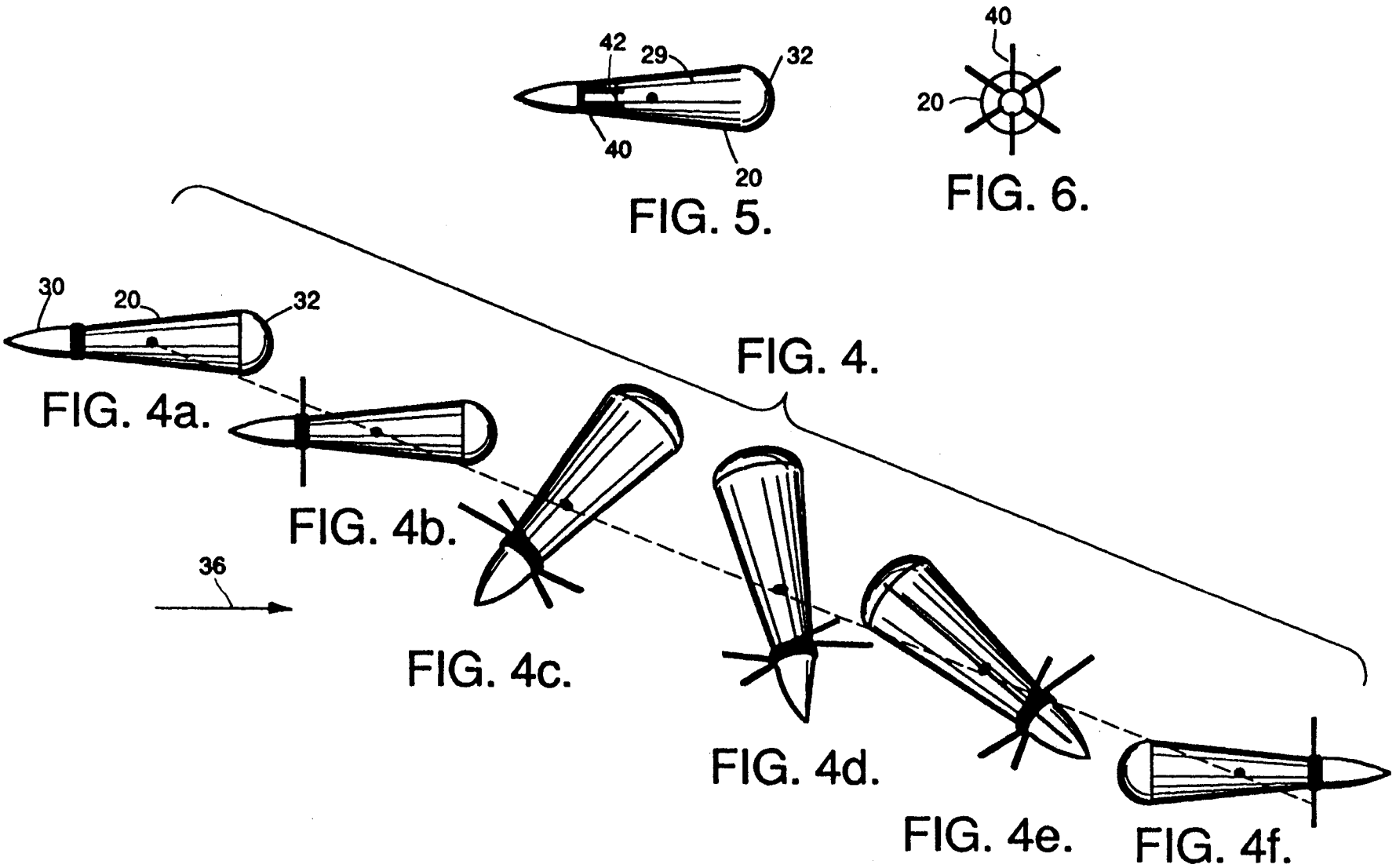
FIGS. 4 and 4(*a*)–4(*f*) are a sequential view of the missile of FIGS. 2 and 3 tumbling from the first stable orientation to the second stable orientation.
FIG. 5 is a side elevational view of a missile having a rearwardly folded aerotumbling device prior to deployment.
FIG. 6 is a front elevational view of the missile of FIG. 5, with the aerotumbling device deployed.

The missile 20 further includes a controllably deployable device 38 that destabilizes the missile 20 so that it is no longer aerodynamically stable with the nose 30 pointed into the flowing fluid stream 36. FIG. 2 illustrates the missile 20 with the deployable device 38 in a stowed position. FIG. 3 illustrates the missile 20 with the deployable device 38 in the deployed position. FIG. 4 illustrates the effect of deployment.

In the embodiment of FIGS. 2–4, the deployable device 28 is at least one, and preferably a plurality, of aerodynamic lifting surfaces such as blades 40 that are wrapped circumferentially around the body 29 of the missile 20 in the stowed position (FIG. 2). The blades 40 are supported on the body of the missile 20 at a location between the nose 30 and the center of gravity 33. The blades 40 are preferably made of a springy material such as spring steel, and are fixed to the body 29 such that they are biased toward the deployed position illustrated in FIG. 3. That is, when no restraining force is applied to the blades 40, they naturally move to the deployed position shown in FIG. 3.

The blades 40 are not permitted to reside in the deployed position of FIG. 3 prior to launch of the missile 20 from the aircraft 22, because in this position they destabilize the missile 20 from the first stable orientation with the nose pointed into the flowing fluid stream. If the missile were launched with the blades deployed, the missile would immediately tumble, preventing targeting and possibly even damaging the aircraft during launch.

Instead, the blades 40 are carried in the stowed position depicted in FIG. 2 prior to deployment after launch. In the embodiment of FIG. 2, the blades 40 are restrained in their stowed position by a restraining wire 42 extending circumferentially around the body 29 of the missile 20 that captures the blades 40 thereunder and holds the blades 40 firmly but releasably against the body of the missile 20. (The term "wire" as used herein in relation to the restraining wire 42 includes conventional wires of generally round shape and also wide bands that may be necessary to capture all of the blades.)

A pyrotechnic device 44 such as a conventional explosive wire cutter is fixed to the restraining wire 42. Upon command the pyrotechnic device 44 operates to sever the restraining wire 42. The blades 40 are then freed to spring outwardly from the stowed position of FIG. 2 to the deployed position of FIG. 3. The pyrotechnic device 44 is normally sequenced to prevent operation until after the missile 20 has dropped free of the aircraft for some distance or period of time, so that the blades 40 are not deployed when the missile 20 is near the aircraft 22.

FIG. 4 depicts the various uses of the missile for forward and rearward operation and an aerotumbling maneuver. In FIG. 4(*a*), the nose 30 of the missile 20 is pointed into the flowing airstream 36 with the blades 40 stowed against the body 29 of the missile 20, depicted in FIG. 2 as it would be carried on an aircraft. The missile is aerodynamically stable in this configuration, and may be driven forward by its engine 34 and conventional control system. In this orientation, the missile would be used primary for an offensive role.

In other instances, the missile 20 is used against an attack from the rear by an opposing aircraft. FIGS. 4(*b*)–4(*f*) depict the sequencing of events following deployment of the blades 40 to rapidly reverse the pointed direction of the missile 20 so that it may be brought to bear against an aircraft attacking from the rear. In FIG. 4(*b*), the pyrotechnic device 44 has been fired, and the blades 40 are deployed in the manner discussed with respect to FIG. 3.

The outwardly extending blades 40 produce a destabilizing aerodynamic force. This destabilizing force is created because the deployed blades 40 act much like the feathers on an arrow to swing their point of support on the missile body to the rear relative to the flowing air stream 36. Consequently, the missile body 29 begins to pivot or tumble from the first stable orientation of FIG. 4(*a*) and FIG. 4(*b*) toward a second stable orientation of FIG. 4(*f*), with the tail 32 of the missile 20 pointing into the flowing air stream 36. FIGS. 4(*b*)–4(*f*) illustrate the progression of movement of the missile 20 from the first stable orientation (FIG. 4(*b*)) to the second stable orientation (FIG. 4(*f*)).

As the missile 20 tumbles from the first stable orientation to the second stable orientation, the target acquisition system of the missile is activated to acquire and lock onto the attacking aircraft or a missile fired by that aircraft. The engine 34 is fired, and the missile 20 acts to defend its launch aircraft 22 against the threat.

After the tumbling maneuver of FIG. 4 is completed, the missile 20 may be operated in the second stable orientation of FIG. 4(*f*) with the engine 34 firing, as long as the net velocity of the missile 20 with respect to the flowing air stream 36 has a net component in the direction shown in FIG. 4. However, if the velocity of the missile becomes sufficiently great, the deployed blades 40 will tend to destabilize the missile once again, possibly causing the missile to tumble again and reverse its direction, an undesirable result.

The tendency to tumble back to the prior orientation may be controlled in one of two ways. In the first, the control system of the missile 20 (i.e., thrusters or control surfaces) may be operated to counteract the destabilizing effect of the deployed blades 40. Alternatively, the entire deployable device 38, including the blades 40, may be separated from the missile 20 to fall free. Separation can be effected by using a second pyrotechnic device 46 that operates on the support structure that holds the deployable device 38 in place against the body of the missile. For example, the deployable device 38 and the blades 40 may be held against the body 29 of the missile 20 with one or a few wires that complete a band around the circumference of the body of the missile 20, with the blades 40 supported on the band. Operation of the pyrotechnic device 46 severs the wires that hold the deployable device 38 in place, and the deployable device falls free of the missile 20 as the missile accelerates. The missile 20 remains stable with its nose pointed toward the target, with the aerotumbling deployable device 38 removed.

FIGS. 5 and 6 depict another embodiment of the missile 20, using blades 40 that fold flat against the body 29 toward the tail 32 of the missile 20. The side view of FIG. 5 illustrates the blades 40 in the stowed position with a restraining wire 42 in place. The wire 42 is controllably severed by a pyrotechnic device similar to that of the device 44 of FIG. 2, and the blades 40 deploy to the position illustrated in the front view of FIG. 6. As a result of the deployment of the blades, the missile 20 tumbles in the same manner as illustrated in FIG. 4.

The present invention provides a controllable aerotumbling device that may be activated to rapidly change the direction of flight of a missile, without the expenditure of fuel. It may be left inactivated, so that the missile operates in the normal manner, or activated at any point in flight to provide a rapid change in direction. The aerotumbling device is relatively simple in construction and operation, and does not add a large amount of weight to the missile. It may be applied to various types of missiles, such as air-launched missiles and torpedoes. Although a particular embodiment of the invention has been described in detail for purposes of illustration, various modifications may be made without departing from the spirit and scope of the invention. Accordingly, the invention is not to be limited except as by the appended claims.

What is claimed is:

1. A missile, comprising:

a missile body having a nose, a tail, and a center of gravity therebetween, the missile body having a first stable orientation with the nose pointed into a flowing fluid stream;

controllable means for forcing the missile to tumble from the first stable orientation to a second stable orientation with the tail facing toward the flowing fluid stream, the controllable means for forcing includes a lifting surface that is extendible into a flowing fluid stream at a location between the nose and the center of gravity; and means for operating the controllable means for forcing.

2. The missile of claim 1, wherein the controllable means for forcing includes a plurality of lifting surfaces arranged around the missile body at a location between the nose and the center of gravity.

3. The missile of claim 2, wherein the lifting surfaces are deployable from a stowed position folded flat against the body of the missile to a deployed position extending into the fluid stream.

4. The missile of claim 3, wherein the lifting surfaces are folded toward the tail of the missile against the body of the missile in the stowed position.

5. The missile of claim 3, wherein the lifting surfaces are folded circumferentially around the body of the missile in the stowed position.

6. The missile of claim 3, wherein the means for operating includes means for holding the lifting surfaces flat against the body of the missile and for releasing the lifting surfaces to extend into the fluid stream.

7. The missile of claim 1, further including controllable means for separating the means for forcing from the missile.

8. The missile of claim 1, wherein the missile body has a teardrop shape.

9. A missile, comprising:

a missile body having a nose, a tail, and a center of gravity therebetween, the missile body having a first stable orientation with the nose pointed in a first direction:

deployable means for reorienting the missile so that it is no longer stable with the nose pointed in the first direction and so that the tail of the missile is pointed in the first direction, the deployable means for reorienting includes a lifting surface that is extendible into a flowing fluid stream at a location between the nose and the center of gravity; and means for controllably deploying the deployable means for reorienting.

10. The missile of claim 9, wherein the deployable means includes a plurality of lifting surfaces arranged symmetrically around the missile body at a location between the nose and the center of gravity.

11. The missile of claim 10, wherein the lifting surfaces are deployable from a stowed position folded flat against the body of the missile to a deployed position extending into the fluid stream.

12. The missile of claim 11, wherein the lifting surfaces are folded toward the tail of the missile against the body of the missile in the stowed position.

13. The missile of claim 11, wherein the lifting surfaces are folded circumferentially around the body of the missile in the stowed position.

14. The missile of claim 9, further including a propulsion engine operable in the air.

15. The missile of claim 9, wherein the deployable means comprises a plurality of blades arranged symmetrically around the circumference of the missile body at a location between the nose and the center of gravity, the blades being deployable from a stowed position folded flat against the body of the missile to a deployed position extending outwardly from the body of the missile and being biased toward the deployed position, wherein each blade is oriented to act as a lifting surface when deployed during flight of the missile.

* * * * *